US011764548B2

(12) United States Patent
Hara

(10) Patent No.: US 11,764,548 B2
(45) Date of Patent: Sep. 19, 2023

(54) SPARK PLUG

(71) Applicant: DENSO CORPORATION, Kariya (JP)

(72) Inventor: Satoshi Hara, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 17/982,758

(22) Filed: Nov. 8, 2022

(65) Prior Publication Data

US 2023/0163575 A1 May 25, 2023

(30) Foreign Application Priority Data

Nov. 25, 2021 (JP) ..... 2021-190680

(51) Int. Cl.
*H01T 13/39* (2006.01)

(52) U.S. Cl.
CPC ..... *H01T 13/39* (2013.01)

(58) Field of Classification Search
CPC ..... H01T 13/39
USPC ..... 313/141
See application file for complete search history.

(56) References Cited

U.S. PATENT DOCUMENTS

2002/0017847 A1 2/2002 Kato et al.
2002/0079800 A1* 6/2002 Miyashita ..... H01T 13/39 313/143
2007/0222350 A1* 9/2007 Lykowski ..... H01T 13/32 313/141
2018/0019579 A1* 1/2018 Kawade ..... H01T 21/02
2020/0321756 A1* 10/2020 Akiyoshi ..... H01T 13/20

FOREIGN PATENT DOCUMENTS

JP 2019110114 A * 7/2019 ..... C22C 5/04
JP 2022087003 A * 6/2022

* cited by examiner

*Primary Examiner* — Christopher M Raabe
(74) *Attorney, Agent, or Firm* — Nixon & Vanderhye P.C.

(57) ABSTRACT

A spark plug includes a first discharge chip and a second discharge chip facing the first discharge chip to define a spark gap therebetween. The spark gap has a size or distance between the first and second discharge chips which is 0.23 mm or more and 0.6 mm or less. At least one of the first and second discharge chips is made from material mainly containing iridium or platinum and an additive of tantalum of 0.5 Wt % to 5.0 Wt %. This minimizes a risk that a portion of the first or second discharge chip may be separated or such a separated portion may be redeposited on the first or second discharge portion.

4 Claims, 1 Drawing Sheet

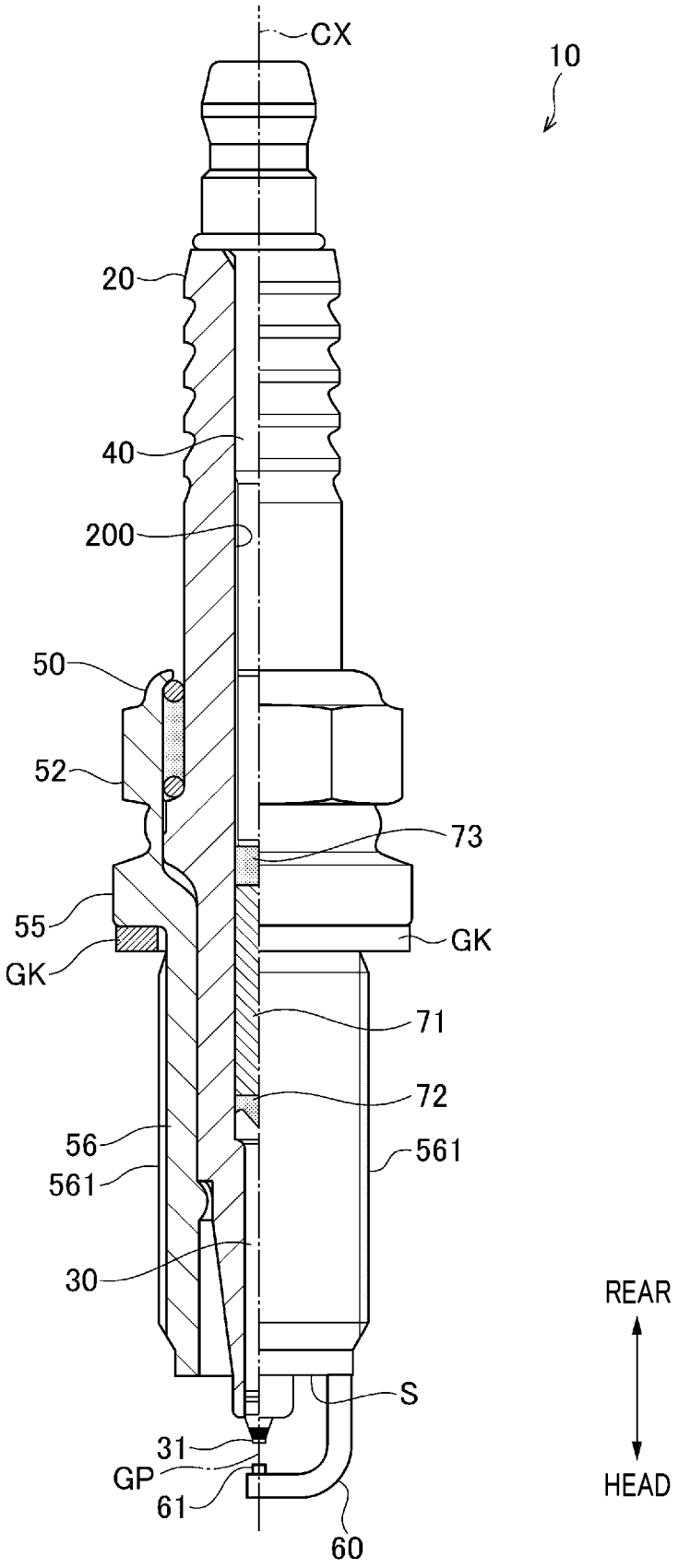
CX
10
20
40
200
50
52
73
55
GK
GK
71
72
56
561
561
30
REAR
S
31
GP
61
HEAD
60

SPARK PLUG

CROSS REFERENCE TO RELATED DOCUMENT

The present application claims the benefit of priority of Japanese Patent Application No. 2021-190680 filed on Nov. 25, 2021, the disclosure of which is incorporated in its entirety herein by reference.

BACKGROUND

1 Technical Field

This disclosure relates generally to a spark plug.

2 Background Art

Internal combustion engines mounted in automotive vehicles are usually equipped with a spark plug to ignite fuel. The spark plug includes a center electrode and a ground electrode and works to produce a sequence of electrical sparks between the center and ground electrodes to ignite the fuel. Japanese Patent No. 4761401 discloses a spark plug designed to have a portion where electrical sparks are produced and which is made from a metallic material mainly containing iridium or platinum.

Usually, when the internal combustion engine is operating, thermal energy arising from the combustion of an air-fuel mixture is developed cyclically, thus causing a portion(s) of the spark plug where electrical sparks occur to be subjected to severe heat/cooling cycles. This may lead to a risk that each of the center and ground electrodes may experience separation of a portion of a metallic surface therefrom and that the separated portion may be melted and then adhered to the surface of the center or ground electrodes again. Such metal re-attachment is also referred to as redeposition.

The occurrence of the redeposition at portion (a) of the spark plug (which will also be referred to as a discharge portion) where the sparks occur may result in a reduction in size of the spark gap, which leads to a short-circuit between the center and the ground electrodes. Particularly, spark plugs which are designed for small-sized gas engines in which the size of the spark gap is approximately 0.2 mm usually encounter an increased risk of a short-circuit between the center and ground electrodes due to redeposition.

In order to eliminate the above drawback, the spark plug disclosed in the above patent publication is designed to have a noble metal chip which is used with an electrode and made from material whose content of oxygen is in a given range to alleviate a risk of partial separation of the surface from the noble metal chip or the redeposition on the noble metal chip.

In recent years, internal combustion engines have been highly required to enhance the efficiency in operation or output power therefrom. Such a requirement is, however, difficult to meet in the spark plug taught in the above patent publication.

SUMMARY

It is an object of this disclosure to provide a spark plug which is capable of minimizing separation of part from a discharge portion of the spark plug or redeposition of the part on the discharge portion.

According to one aspect of this disclosure, there is provided a spark plug which comprises: (a) a first discharge chip; (b) a second discharge portion which faces the first discharge portion; and (c) a spark gap which is defined between the first discharge portion and has a size of 0.23 mm or more and 0.6 mm or less. At least one of the first discharge portion and the second discharge portion is made from material mainly containing iridium or platinum and an additive of tantalum of 0.5 Wt % to 5.0 WT %.

The inventor has knowledge that a risk of the separation of part from a discharge portion(s) of a spark plug or the redeposition of the part on the discharge portion is minimized by making the discharge portion from material mainly containing iridium or platinum and an additive of tantalum of 0.5 Wt % to 5.0 Wt % with the aid of solution hardening (also called solid solution strengthening) in production of the discharge portion. The spark plug is, therefore, designed to have the first discharge portion and the second discharge portion at least one of which is made from the above-described material to eliminate the risk of the separation of part from the first and/or second discharge portions or the redeposition of the part on the first and/or second discharge portions.

BRIEF DESCRIPTION OF THE DRAWINGS

The present disclosure will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings:

FIG. 1 is a partially longitudinal sectional view which illustrates a structure of a spark plug according to an embodiment in this disclosure.

DESCRIPTION OF THE PREFERRED EMBODIMENTS

The structure of the spark plug 10 according to the embodiment will first be described with reference to FIG. 1. FIG. 1 illustrates a longitudinal sectional view of the spark plug 10, as cut along the center axis CX, on the left side of the drawing, but shows the external appearances of the center electrode 30 and the metal terminal 40 as they are on the left side of the drawing.

The spark plug 10 is mounted in each cylinder of an internal combustion engine, not shown, in use and works to ignite fuel in a combustion chamber in the cylinder. The internal combustion engine may be of any type, however, the spark plug 10 in this embodiment is designed for use in a gas engine or a gasoline engine. The spark plug 10 includes the porcelain insulator 20, the center electrode 30, the metal terminal 40, the metal shell 50, and the ground electrode 60.

The porcelain insulator 20 is of a hollow cylindrical shape and made from insulating material, such as alumina. The porcelain insulator 20 has formed therein the axial hole 200 which extends through the center axis of the porcelain insulator 20. The axial hole 200 has the center axis coinciding with that of the porcelain insulator 20. The center axis (i.e., a longitudinal center line) of the axial hole 200 will also be referred to as the center axis CX. The axial hole 200 is shaped to have a circular transverse section, as viewed in a cross section of the porcelain insulator 20 taken perpendicular to the center axis CX.

The axial hole 200 has a given length with a first end portion (i.e., a lower end portion, as viewed in the drawing) and a second end portion (i.e., an upper end portion, as viewed in the drawing). The first end portion will also be referred to as a head end portion or a head end side, while the second end portion will also be referred to as a rear end portion or a rear end side. The center electrode 30 is made of a metallic material and retained by the porcelain insulator 20 in the first end portion (i.e., the head end portion) of the axial hole 200. The center electrode 30 is of a bar-shape and mostly disposed inside the axial hole 200. The center electrode 30 has a head end portion which protrudes from the axial hole 200 outside the porcelain insulator 20 and has the discharge chip 31 secured to the tip thereof. The porcelain insulator 20 also serves as a member which retains an outer periphery of the center electrode 30.

The metal terminal 40 is made of metallic material and arranged in the second end portion (i.e., the rear end portion) of the axial hole 200. The metal terminal 40 extends along the center axis CX and is retained by the porcelain insulator 20. The metal terminal 40 is of a bar-shape and mostly disposed inside the axial hole 200. The metal terminal 40 has a portion which protrudes from the axial hole 200 outside the porcelain insulator 20 and functions as an electrode terminal to which voltage is applied from an external power supply, not shown.

The porcelain insulator 20 has a portion in which the center electrode 30 extends along the center axis CX and which will also be referred to below as a head end portion or a head end side. The porcelain insulator 20 has also a portion in which the metal terminal 40 extends along the center axis CX and which will also be referred to as a rear end portion or a rear end side.

The axial hole 200 has the resistor 71 disposed therein between the metal terminal 40 and the center electrode 30. The resistor 71 is an electrical component working to control or regulate an electrical resistance of an electrical circuit extending from the metal terminal 40 to the center electrode 30. The resistor 71 is made from material of glass and zirconia powder with a selected amount of additive of carbon powder. The degree of electrical resistance implemented by the resistor 71 is determined by the added amount of carbon powder. The resistor 71 arranged in the electrical circuit between the metal terminal 40 and the center electrode 30 serves to minimize electromagnetic noises arising from spark discharge from the spark plug 10. The resistor 71 and the center electrode 30 are electrically connected together through the conductive sealing layer 72. Similarly, the metal terminal 40 and the resistor 71 are electrically connected together through the conductive sealing layer 73. Each of the conductive sealing layers 72 and 73 is made from glass powder with an additive of copper powder in the form of a conductive layer.

The metal shell 50 is of a hollow cylindrical shape and surrounds a portion of the porcelain insulator 20 from outside. The whole of the metal shell 50 is made from metallic material. The metal shell 50 is mechanically crimped to make a firm joint to the porcelain insulator 20, so that the metal shell 50 firmly retains the porcelain insulator 20. The metal shell 50 includes the gripping portion 52, the flange 55, and the insertion portion 56.

The gripping portion 52 is used to provide a mechanical grip to a tool, such as a plug wrench, to attach the spark plug 10 to the internal combustion engine. The gripping portion 52 is of, for example, a hexagonal shape, as viewed along the center axis CX.

The flange 55 is arranged in contact with the outer surface of the internal combustion engine through the gasket GK when the spark plug 10 is mounted in the internal combustion engine. The flange 55 is located closer to the head of the spark plug 10 (i.e., the metal shell 50) than the gripping portion 52 is and protrudes radially outward.

The insertion portion 56 is a portion of the metal shell 50 which is located closer to the head of the spark plug 10 than the flange 55 is and inserted into a hole, not shown, formed in the internal combustion engine. The insertion portion 56 has the male thread 561 formed on an outer periphery thereof and is rotated around the center axis CX by mechanical pressure exerted by a tool on the gripping portion 52 when the spark plug 10 is mounted in the internal combustion engine. This achieves mechanical engagement between a female thread formed in the hole of the internal combustion engine and the male thread 561 of the insertion portion 56, thereby tightly fastening the spark plug 10 to the internal combustion engine. After the spark plug 10 is installed in the internal combustion engine, the electrical potential at the metal shell 50 will be at the same ground potential as the body of the internal combustion engine.

The ground electrode 60 is made of a metallic member extending from an end surface S of the head of the metal shell 50. The end surface S extends perpendicular to the center axis CX. The ground electrode 60 is bent to have a portion (which will also be referred to as a head portion) which faces the discharge chip 31 of the center electrode 30 in the lengthwise direction of the center axis CX. The ground electrode 60 has a length with a first end and a second end opposed to the first end. The ground electrode 60 is joined at the first end to the end surface S of the metal shell 50 and has the second end (i.e., the head portion) facing the center electrode 30. The head portion of the ground electrode 60 which faces the discharge chip 31 has the discharge chip 61 secured thereto. The discharge chip 61 and the discharge chip 31 are, therefore, aligned with each other along the center axis CX. The discharge chip 61 and the discharge chip 31 face each other through the spark gap GP in which the electrical spark is created. The spark gap GP is schematically illustrated in FIG. 1, however, an actual size of the spark gap GP is selected to lie in a small range of 0.23 mm or more and 0.6 mm or less. The size of the spark gap GP, as referred to herein, represents a minimum distance between the discharge chip 31 and the discharge chip 61.

In operation of the internal combustion engine, a high voltage is applied in the form of a pulse between the metal terminal 40 of the spark plug 10 and the body of the internal combustion engine. The high-voltage is then applied between the discharge chip 61 and the discharge chip 31 which face each other, thereby creating a spark discharge in the spark gap GP.

The discharge chip 31 is welded to a joint counterpart, i.e., the center electrode 30. Similarly, the discharge chip 61 is welded to a joint counterpart, i.e., the ground electrode 60. The discharge chip 31 will also be referred to as a first discharge portion. The discharge chip 61 will also be referred to as a second discharge portion. Each of the discharge chip 31 and the discharge chip 61 is, as will be described later in detail, designed in the form of a noble metal chip made from material mainly containing iridium (Ir) or platinum (Pt).

Usually, when the internal combustion engine is operating, thermal energy arising from the combustion of an air-fuel mixture is developed cyclically, thus causing a portion of the spark plug 10 where electrical sparks occur to be subjected to severe heat/cooling cycles. This may lead to a risk that each of the discharge chip 31 and the discharge chip 61 may experience separation of a portion of a metallic surface therefrom and that the separated portion may be melted and then adhered to the surface of the discharge chip 31 or 61 again. Such metal re-attachment is also referred to as redeposition.

The occurrence of the redeposition at the discharge chip 31 or the discharge chip 61 may result in a reduction in size of the spark gap GP, which leads to a short-circuit between the center electrode 31 and the ground electrode 60. The spark plug 10 which is designed for small-sized gas engines in which the size of a spark gap is approximately 0.2 mm usually encounters an increased risk of a short-circuit between the center electrode 31 and the ground electrode 60 due to the redeposition.

In order to alleviate the above problem, the spark plug 10 is designed to have the discharge chip 31 whose material is selected to minimize the separation of the surface from the discharge chip 31 and/or the redeposition on the discharge chip 31. The material of the discharge chip 31 is a metallic material which contains iridium (Ir) as a main composition and tantalum (Ta) whose amount is in a range of 0.5 percent by weight (Wt %) to 5 Wt %. The main component or the phrase "mainly contain", as referred to herein, means that the ratio of mass of a substance of material to a total mass of the material is 50% or more.

In order to evaluate advantages offered by the discharge chip 31 made of the above material, the inventor of this application conducted the following tests. First, eight types of alloys were prepared which mainly contain iridium. Specifically, the alloys were made by adding a given quantity of tantalum (Ta) to a metallic material containing iridium of 90 Wt % and rhodium (Rh) of 10 Wt % and then melting it. The alloys were different in content of tantalum from each other.

Subsequently, each of the alloys was forged, extended using pressure into a cylindrical shape of 1 mm in diameter, and then cut into 1 mm in length. In this way, eight types of specimens of the discharge chip 31 for different contents of tantalum. The discharge chip 61 was also prepared which was made from an alloy containing iridium of 90 Wt %, rhodium (Rh) of 10 Wt %, and tantalum of 0 Wt %, in other words, containing only iridium and rhodium.

Afterwards, specimens of the spark plug 10 were made which are equipped with the above different types of specimens of the discharge chip 31 and the above type of discharge chip 61. Each specimen of the spark plug 10 was installed in the internal combustion engine. After the internal combustion engine was driven for a given period of time, we checked each specimen of the spark plug 10 for the degree of redeposition on each of the discharge chips 31 and 61. The degree of redeposition was evaluated using the largest diameter (which will also be referred to as a redeposited particle diameter) among particles deposited on each of the discharge chips 31 and 61.

Each specimen of the spark plug 10 had the spark gap GP whose initial size is 0.23 mm. In the tests, the internal combustion engine was driven at 750 rpm and 8,500 kW for 2,000 hours.

Results of the tests are shown in table 1 below.

TABLE 1

| Added Ta amount Wt % | 0 | 0.2 | 0.5 | 1 | 2 | 3 | 4 | 5 |
|---|---|---|---|---|---|---|---|---|
| center electrode redeposited particle diameter mm (Ta) | 0.09 | 0.07 | 0.03 | 0.03 | 0.03 | 0.02 | 0.02 | 0.02 |
| ground electrode redeposited particle diameter mm (No Ta) | 0.1 | 0.1 | 0.1 | 0.1 | 0.1 | 0.1 | 0.1 | 0.1 |
| TOTAL mm | 0.19 | 0.17 | 0.13 | 0.13 | 0.13 | 0.12 | 0.12 | 0.12 |

In table 1, the first row "added Ta amount" lists Wt % of tantalum contained in the eight types of specimens of the discharge chip 31. Specifically, the eight types of specimens of the discharge chip 31 contain 0 Wt %, 0.2 Wt %, 0.5 Wt %, 1.0 Wt %, 2.0 Wt %, 3.0 Wt %, 4 Wt %, and 5.0 Wt % of tantalum, respectively. The reason why the content of tantalum in the discharge chip 31 is a maximum of 5.0 Wt % is because 5.0 Wt % or more of tantalum usually results in an increase in hardness of the material of the discharge chip 31, which leads to a difficulty in machining the discharge chip 31.

In table 1, the second row "center electrode redeposited particle diameter" lists diameters of particles adhered to the specimens of the discharge chip 31. The third row "ground electrode redeposited particle diameter" lists diameters of particles adhered to the specimens of the discharge chip 61 made from material excluding tantalum. The fourth row "total" lists totals of the diameters of particles adhered to the specimens of the discharge chips 31 and 61.

The sum of the center electrode redeposited particle diameter and the ground electrode redeposited particle diameter represents a decrease in size of the spark gap GP from an initial size thereof. It is advisable that typical spark plugs for gas engines have the spark gap whose size is 0.1 mm or more in order to ensure the stability in igniting the air-fuel mixture. Accordingly, in the above tests where the initial size of the spark gap GP is selected to be 0.23 mm, the sum of the center electrode redeposited particle diameter and the ground electrode redeposited particle diameter needs to be 0.13 mm or less.

Table 1 shows that the larger the content of tantalum, the small the center electrode redeposited particle diameter and the smaller the sum of the center electrode and ground electrode redeposited particle diameters. Table 1 also shows that when the content of tantalum is 0.5 Wt % or more, the sum of the center electrode and ground electrode redeposited particle diameters is 0.13 mm or less, in other words, the size of the spark gap GP is kept higher than or equal to 0.1 mm, meaning that the stability in igniting operation of the spark plug 10 is ensured even after the spark plug 10 is operated for 2,000 hours that is usually a target time when typical spark plugs are required to be replaced. We have, therefore, found from the above tests that the content of tantalum in the discharge chip 31 is preferably selected to be 0.5 Wt % or more and 5.0 Wt % or less because the fact that the addition of tantalum to the material of the discharge chip 31 minimizes the separation of the surface from the discharge chip 31 and/or the redeposition on the discharge chip 31 is thought of as resulting from reduction in growth of metallic particles in the discharge chip 31 rather than the solution hardening (also called solid solution strengthening) in production of the discharge chip 31.

The spark plug 10 in this embodiment may be designed to have the discharge chip 31 and the discharge chip 61 at least one which is made from material mainly containing iridium and an additive of tantalum of 0.5 Wt % or more to 5.0 Wt % or less. The discharge chip 61 made from the above material offers the same beneficial advantages as those of the discharge chip 31.

The inventor of this application also conducted tests which will be described below.

First, specimens of the spark plug 10 were prepared which are equipped with the discharge chip 61 made from the same material as that of the discharge chip 31. The tests were conducted on such specimens and evaluated in the same way as described above. Specifically, we prepared specimens of each of the discharge chip 31 and the discharge chip 61 which are made from eight types of materials different in content of tantalum from each other.

Results of the tests are shown in table 2 below.

TABLE 2

| Added Ta amount Wt % | 0 | 0.2 | 0.5 | 1 | 2 | 3 | 4 | 5 |
|---|---|---|---|---|---|---|---|---|
| center electrode redeposited particle diameter mm (Ta) | 0.09 | 0.07 | 0.03 | 0.03 | 0.03 | 0.02 | 0.02 | 0.02 |
| ground electrode redeposited particle diameter mm (No Ta) | 0.1 | 0.09 | 0.05 | 0.05 | 0.04 | 0.03 | 0.03 | 0.03 |
| TOTAL mm | 0.19 | 0.16 | 0.08 | 0.08 | 0.07 | 0.05 | 0.05 | 0.05 |

In table 2, the first row "added Ta amount" lists Wt % of tantalum contained in the eight types of specimens of each of the discharge chip 31 and the discharge chip 61. The second row "center electrode redeposited particle diameter" lists diameters of particles adhered to the specimens of the discharge chip 31. The third row "ground electrode redeposited particle diameter" lists diameters of particles adhered to the specimens of the discharge chip 61. The fourth row "total" lists the sums of the diameters of particles adhered to the specimens of the discharge chips 31 and 61.

Table 2 shows that the larger the content of tantalum, the smaller the center electrode redeposited particle diameter and the smaller the sum of the center electrode and ground electrode redeposited particle diameters. Table 2 also shows that when the content of tantalum is 0.5 Wt % or more, the sum of the center electrode and ground electrode redeposited particle diameters is 0.13 mm or less, in other words, the size of the spark gap GP is kept higher than or equal to 0.1 mm. We have found from the above tests that the content of tantalum in the noble metal material of each of the discharge chip 31 and the discharge chip 61 is preferably selected to be 0.5 Wt % or more and 5.0 Wt % or less.

As apparent from the above discussion, the spark plug 10 may be designed to have the discharge chip 31 (i.e., the first discharge portion) and the discharge chip 61 (i.e., the second discharge portion) either or both of which are made from material containing iridium as a main composition and an additive of tantalum of 0.5 Wt % or more to 5.0 Wt % or less.

Although results of tests are omitted, the inventor of this application has found that substantially the same beneficial advantages as those described above are obtained in a case where at least one of the discharge chips 31 and 61 is made from a noble metal material containing platinum as a main composition instead of iridium and an additive of tantalum of 0.5 Wt % or more to 5.0 Wt % or less.

The spark plug 10 is, as described above, equipped with the discharge chips 31 and 61 at least one of which is made from material containing iridium or platinum as a main composition and an additive of tantalum of 0.5 Wt % to 5.0 Wt %, but however, may alternatively be designed to have only portions which face each other to define the spark gap GP and are made of the above-described material. For instance, at least one of the center electrode 30 and the ground electrode 60 is made from the above-described material without use of noble metal chips (i.e., the discharge chips 31 and 61). In this case, either of the center electrode 30 or the ground electrode 60 serves as the first discharge portion, while the other may serve as the second discharge portion.

The component parts described in the above embodiment are not necessarily essential unless otherwise specified or viewed to be essential in principle. When the number of the component parts, a numerical number, a volume, or a range is referred to in the above discussion, this disclosure is not limited to it unless otherwise specified or viewed to be essential in principle. Similarly, when the shape of, the orientation of, or the positional relation among the component parts is referred to in the above discussion, this disclosure is not limited to it unless otherwise specified or viewed to be essential in principle.

What is claimed is:

1. A spark plug comprising:
a first discharge portion;
a second discharge portion which faces the first discharge portion; and
a spark gap which is defined between the first discharge portion and has a size of 0.23 mm or more and 0.6 mm or less, wherein
at least one of the first discharge portion and the second discharge portion is made from material mainly containing iridium or platinum and an additive of tantalum of 0.5 Wt % to 5.0 Wt %.

2. The spark plug as set forth in claim 1, wherein the first discharge portion and the second discharge portion are both made from material mainly containing iridium or platinum and an additive of tantalum of 0.5 Wt % to 5.0 Wt %.

3. The spark plug as set forth in claim 1, wherein at least one of the first discharge portion and the second discharge portion is configured in a form of a noble metal chip joined to a given counterpart of the spark plug.

4. The spark plug as set forth in claim 1, wherein the at least one of the first discharge portion and the second discharge portion is made from material mainly containing platinum and the additive of tantalum of 0.5 Wt % to 5.0 Wt %.

* * * * *